US007044820B2

(12) United States Patent
Ladisa

(10) Patent No.: US 7,044,820 B2
(45) Date of Patent: May 16, 2006

(54) BALLS WITH GRIPPING HANDLES

(76) Inventor: Nicolas F. Ladisa, 3701 S. George mason Dr., Apt. 2013-N, Falls Church, VA (US) 22041

( * ) Notice: Subject to any disclaimer, the term of this patent is extended or adjusted under 35 U.S.C. 154(b) by 0 days.

(21) Appl. No.: 10/902,809

(22) Filed: Aug. 2, 2004

(65) Prior Publication Data

US 2005/0202739 A1 Sep. 15, 2005

Related U.S. Application Data

(60) Provisional application No. 60/551,046, filed on Mar. 9, 2004.

(51) Int. Cl.
*B63C 9/08* (2006.01)

(52) U.S. Cl. ..... 441/81

(58) Field of Classification Search ..... 441/81, 441/56; 473/596, 570
See application file for complete search history.

(56) References Cited

U.S. PATENT DOCUMENTS

| | | | | | |
|---|---|---|---|---|---|
| 2,115,926 | A | * | 5/1938 | Hatton | 473/596 |
| 3,185,476 | A | * | 5/1965 | Fechner | 473/596 |
| 3,329,982 | A | * | 7/1967 | Zannoni | 441/92 |
| 3,427,022 | A | * | 2/1969 | Ward | 482/111 |
| 3,450,592 | A | * | 6/1969 | Conrad et al. | 473/595 |
| 3,812,546 | A | * | 5/1974 | Witte | 441/97 |
| 4,738,450 | A | * | 4/1988 | Wexler | 473/598 |
| 5,676,611 | A | * | 10/1997 | Foster et al. | 473/613 |
| 5,888,156 | A | * | 3/1999 | Cmiel et al. | 473/570 |

* cited by examiner

*Primary Examiner*—Stephen Avila

(57) ABSTRACT

A ball comprises a body having an outer surface of sufficient extent to define a volume sufficient to accommodate at least a portion of each of four fingers of a person's hand. The ball has at least one indentation in the surface, the indentation having a depth sufficient to receive at least a portion of four fingers. Each indentation is provided with a gripping surface against which the fingers press while other surfaces of the fingers or the hand engage the outer surface of the ball. In one embodiment, the ball may have only a single indentation, whereas other embodiments the ball has a plurality of indentations. In addition to providing the amusement and exercise device, the ball has uses as a floating safety device.

12 Claims, 4 Drawing Sheets

BALLS WITH GRIPPING HANDLES

RELATED APPLICATION

Priority is claimed to U.S. Provisional Application Ser. No. 60/551,046, filed Mar. 9, 2004 and incorporated by reference herein.

FIELD OF THE INVENTION

The present invention is directed to balls with gripping handles. More particularly, the present invention is directed to balls with gripping handles that are used for recreational purposes as well as for floating devices usable in emergency situations.

BACKGROUND OF THE INVENTION

With the exception of bowling balls which are generally rigid, hard, spheres with finger holes, balls do not usually have gripping surfaces or gripping handles. Consequently, individuals who may be disabled or young children, as well as individuals who can not "palm" footballs and basketballs, have difficulty in playing certain games in which ones performance might be enhanced by being able to handle a relatively large ball with one hand. Moreover, being able to handle a ball with just one hand has advantages in games perhaps yet to be developed where any individual will find the game more interesting because the ball can be easily held with one hand.

SUMMARY OF THE INVENTION

In view of the aforementioned considerations, the present invention is directed to balls provided with indentations that provide gripping surfaces which define handles enabling one to more easily grip a ball, whether that ball is spherical or some other shape such as oblong or oval.

A ball comprises a body having an outer surface of sufficient extent to define a volume sufficient to accommodate at least a portion of each of the four fingers of a person's hand. At least one indentation is provided in the surface, the indentation having a width sufficient to receive at least a portion of each of the four fingers of a person's hand. A gripping surface is disposed within the indentation against which at least tip portions of the four fingers press while other surfaces of the fingers or palm engage the outer surface of the body.

In a further aspect of the ball, the body is spherical.

In another aspect of the ball, the body is oblong.

In still another aspect of the ball, there are a plurality of indentations in the body each with a gripping surface.

In a further aspect of the ball, the body is made of foam.

In a further aspect of the ball, the body has an inner wall surface defining a space which receives air to inflate the ball.

In still a further aspect of the invention the indentation is spanned with a bridge having the gripping surface thereon and the bridge divides the indentation into two sections one of which receives the fingers and the other which receives the thumb of a person's hand.

In still a further aspect of the ball, there are a plurality of indentations and gripping surfaces on the ball.

In still a further aspect of the invention, the body of the ball displaces a mass of water equal to the mass of the ball wherein the ball floats on water and is useful as a safety floatation device.

In still another aspect of the invention, the ball is in combination with at least several other balls of a similar configuration aboard a floating vessel which are releasable when the floating vessel overturns or sinks providing floatation devices which may be gripped by one or more former occupants of the vessel who may find themselves floating on the water without the vessel.

In still a further aspect of the invention, the ball is illuminated by adding a light, being phosphorescent or having a fluorescent color.

In still another aspect of the invention, ball is inflatable by a mouthpiece or by a gas cartridge such as a $CO_2$ cartridge.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DESCRIPTION OF THE PREFERRED EMBODIMENTS

Figure 1:
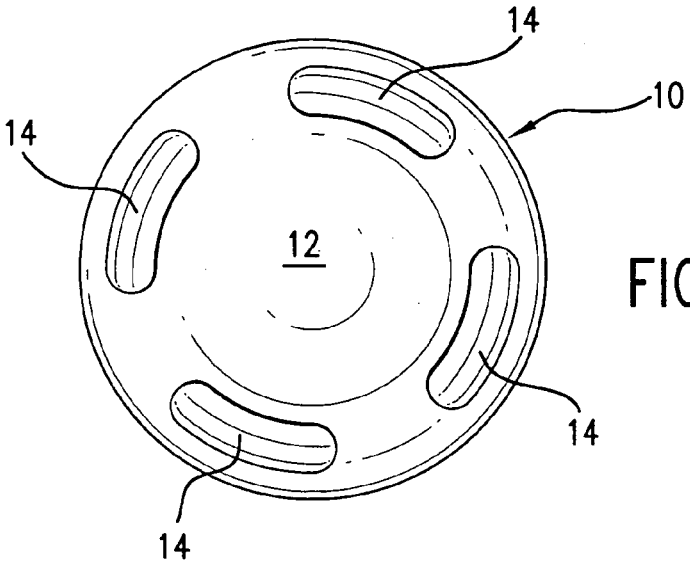
FIG. 1 is a perspective view of a round ball having indentations therein suitable for gripping by one hand.

Referring now to FIG. 1 there is a view of a spherical ball which may be used to play various games or sports and has a surface 12 through which elongated indentations 14 are provided. The elongated indentations 14 provide handles or gripping arrangements for the ball. While four indentations 14 are shown the number of indentations may be any number as long as there is at least one indentation. The indentations 14 have a width W sufficient to accommodate the thickness of the fingers of a person using a ball and a length L sufficient to accept four fingers of a person using the ball. The depth of the indentations 14 varies in accordance with the purposes of the ball being used. For example, in order to provide a sufficient grip, the depth may be sufficient to receive up to three joints of a person's finger or may be shallower so as to receive just the end joint or the end joint plus the middle joints of a person's fingers. In a preferred embodiment, the person's thumb remains outside the indentation on the surface 12 of the ball.

Figure 2:
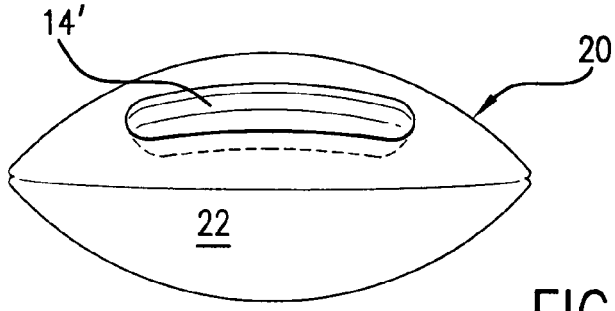
FIG. 2 is a view of an oblong ball such as a football which has an indentation therein for gripping by one hand.

While FIG. 1 shows a spherical ball, a ball may have other shapes such as that of an American football 20 shown in FIG. 2. Generally, footballs are in the shape of an oval with rapidly tapering ends. In order to throw a spiral pass, a player must be able to have a substantial purchase on the football 20 and this is usually achieved by having ones' four fingers over stitching on the exterior surface 22 of the football 20. In accordance with the present invention, purchase is achieved by an indentation 14' which is wide enough and long enough to receive at least a portion of a person's fingers. The depth of the indentation 14' varies from the depth of a single finger joint, which is probably preferable, to two finger joints including the end finger joint and middle finger joint. In some embodiments of the invention, the depth may be less than the length of the end finger joints. While the indentation 14' is shown to be generally straight at its surface, the indentation may also be arcuate following the curvature of the surface 22 of the football 20.

Figure 3:
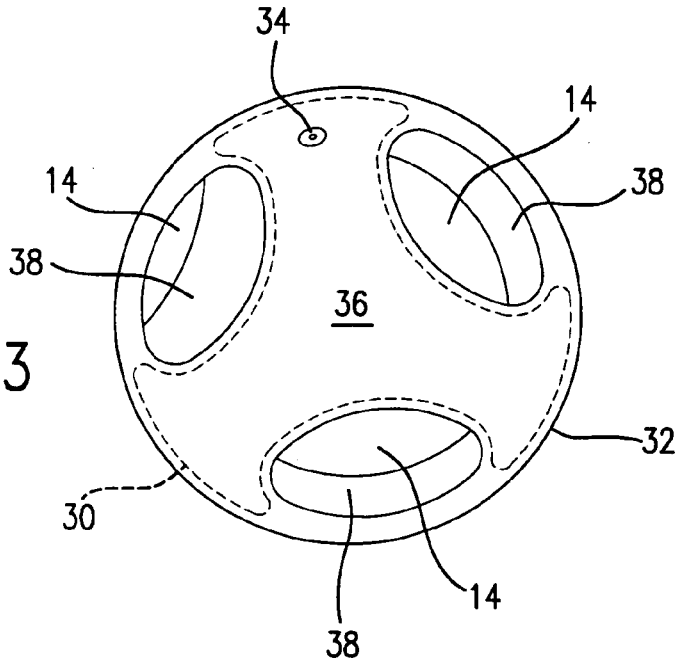
FIG. 3 is sectional view of a ball having indentations therein and being inflatable either with a bladder or without a bladder.

Referring now to FIG. 3 there is shown an inflatable ball that may be spherical, such as the ball 10 of FIG. 1, or may be oval such as the American football 20 of FIG. 2. The ball 10 or 20 may have a bladder 30 or may be bladderless, relying on a gas or air tight shell 32 which develops a desired degree of stiffness upon inflating the ball 10 with a needle inserted through a self-sealing valve 34 which communicates with the interior space 36 of the ball. The indentations 14 are unitary or integral with the casing 32 and are each defined by pockets 38 which extend into the interior space 36 of the ball 10.

Figure 4:
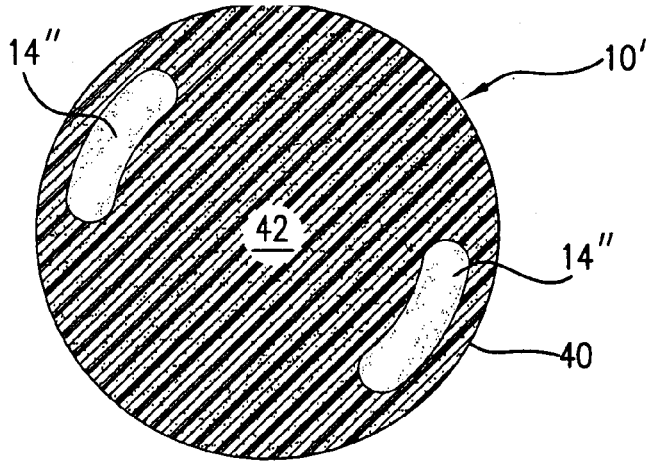
FIG. 4 is a sectional view of a ball having a foam interior and gripping handles.

Referring now to FIG. 4, there is shown a spherical ball 10' having indentations 14" similar to the indentations 14 and 14' of FIGS. 1–3. While the illustrated ball is spherical, the ball may also be of other shapes, such as but not limited to the football 20 of FIG. 2. The ball 10 of FIG. 1 may be of foam material throughout with a foam surface 40 having indentations 14" formed through the foam surface 40, or may have an outer skin such as the casing 32 that has pockets 38 integrally formed therewith or molded therein. The foam mass 42 forming the ball 10' may be of various degrees of stiffness so that the feel of the ball varies from being relatively soft to relatively stiff.

In still another embodiment of the invention, the ball 10 may be relatively soft, flexible and floppy with the hand holes therein so as to be suitable for impact games, such as but not limited to dodge ball.

Figure 10:
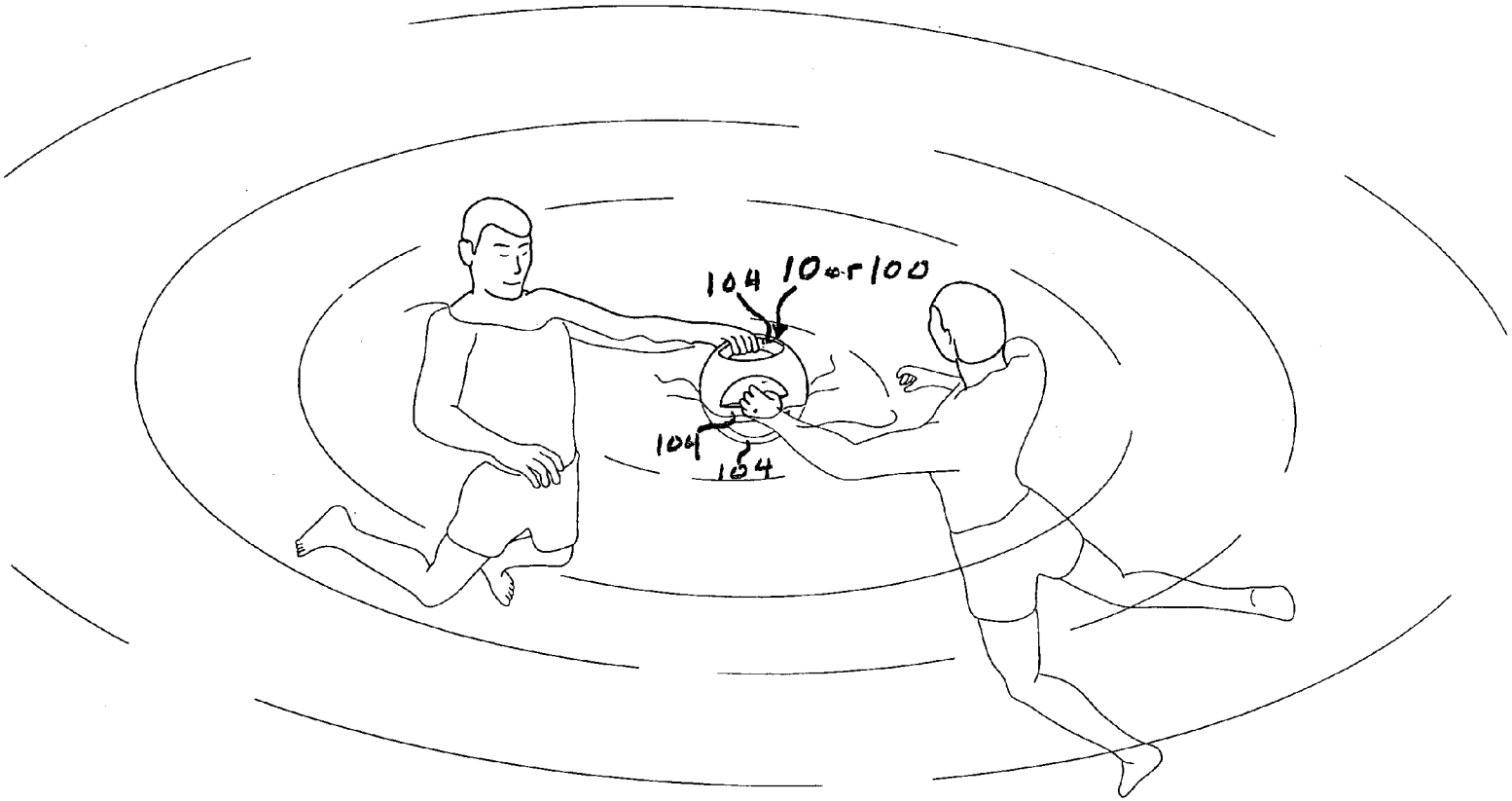
FIG. 10 is a perspective view showing the ball used as a floatation device for helping to support one or more people in a water emergency situation.

While the balls 10 (and 20) are useful for playing games, these balls may also be useful as flotation devices for people who have fallen from boats or piers or for some reason find themselves in relatively deep water (see FIG. 10). They can be thrown a ball 10 with relative accuracy and can grip the surface of the ball 12 using the handles 14 to keep themselves afloat. Numerous balls 10 can be available so that a volley of balls with handles 14 can be tossed to a person or to a group of people who find themselves immersed in deep water and in need of flotation. The balls 10 can be loose in a vessel, so if the vessel capsizes or sinks, the balls float free, providing instant life preservers.

Figure 5:
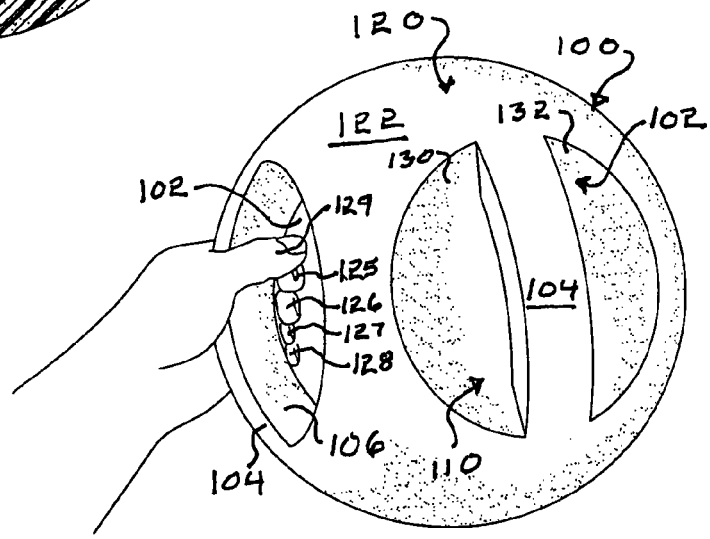
FIG. 5 is a perspective view of an additional embodiment of the invention.
Figure 6:
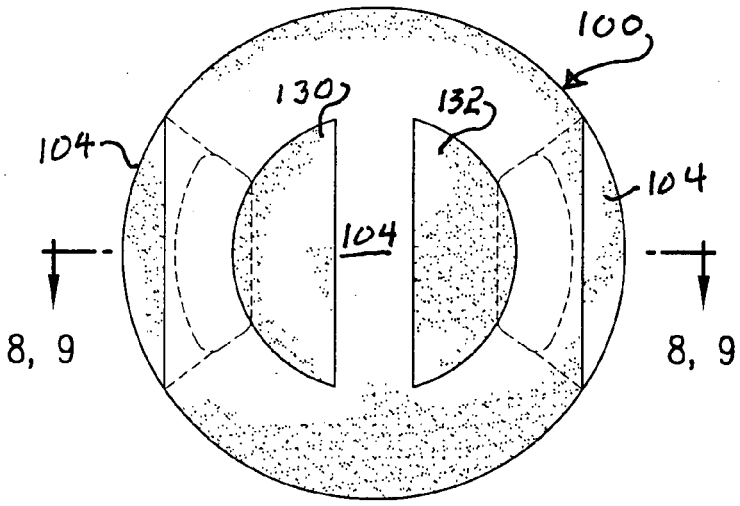
FIG. 6 is a side view of the ball of FIG. 5.
Figure 7:
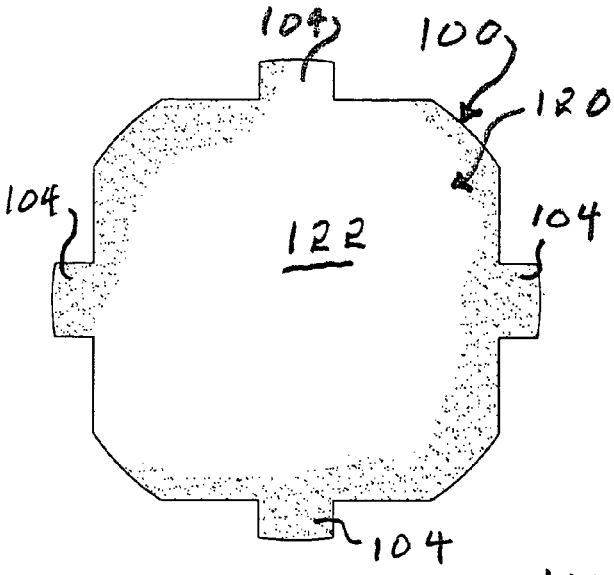
FIG. 7 is a top view of the ball of FIGS. 5 and 6.

Referring now to FIGS. 5–7, there is shown another embodiment of the invention wherein the ball 100 is configured as a sphere having a plurality of indentations 102 in the surface thereof. Each indentation 102 is divided by a bridge 104 having a gripping surface 106 thereon that faces a concave surface 110 defined by the indentation 102.

As is seen in FIG. 5, the ball 100 has a body 120 having an outer surface 122 of a sufficient extent to define a volume sufficient to accommodate at least a portion of each of four fingers 125, 126, 127 and 128 of a person's hand which extend through one of two sections 130 and 132 separated by the bridge 104 which spans each indentation 102. The thumb 129 of the person's hand extends through the other section of the indentation so that the bridge 104 is gripped by the persons hand. The tips of a person's fingers 125–128 bare against the gripping surface 106 which is on the under side of the bridge 104.

Figure 8:
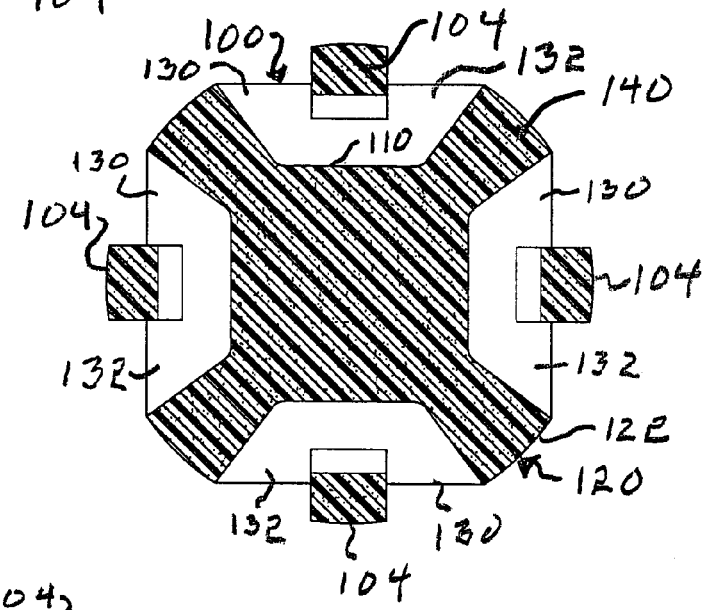
FIG. 8 is an elevational view taken along lines 8—8 of FIG. 6 and showing a foam filled ball.

Referring now to FIG. 8, in a first embodiment of the ball 100 the ball is formed of a foam material 140 which is disposed within the body 120 of the ball and within the bridges 104. The foam 140 may be of any desired degree of stiffness, but it is preferable if the ball 100 is used for playing games that the foam be elastic with a suitable degree of softness. The outer surface 122 is preferably flexible with sufficient strength to resist tearing and puncture.

Figure 9:
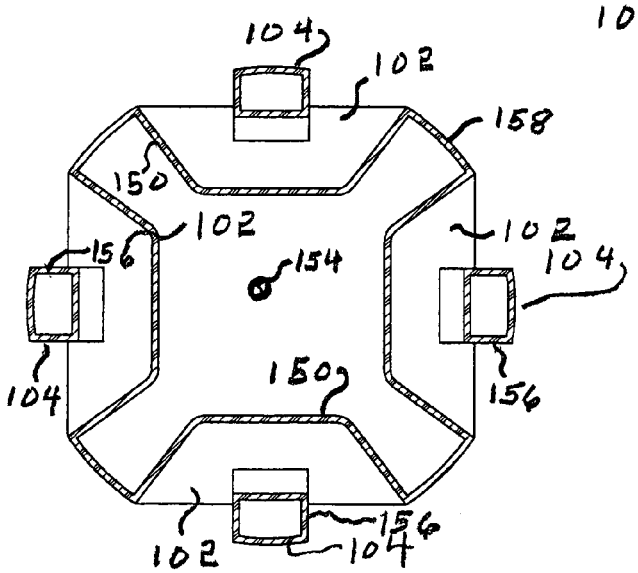
FIG. 9 is an elevational view taken along lines 9—9 of FIG. 6 and showing an embodiment of the ball of FIG. 5 inflated with air.

Referring now to FIG. 9, a second embodiment of the ball 100 includes an inner wall 150 approximate the outer wall 122 to provide an airtight surface wherein the ball is inflatable for a one way valve 154, such as a needle valve, so that the ball may be readily inflatable with air to a desired degree of stiffness or flexibility. In the embodiment of FIG. 9, the portions 156 of the wall defined between the inner and outer surfaces 150 and 122 that form the indentations 102 and bridges 104 are stiffer than the wall portions 158 defining the spherical surfaces of the ball. Consequently, when the ball is inflated the indentations 102 and bridges 104 retain their shape. The indentations 102 and bridges 104 can be shaped by molding the wall of the ball wherein hemispherical segments of the ball 100 are separately molded and then joined together along seams in accordance with known practices.

Referring now primarily to FIG. 10, a ball 100 also finds use as a floatation device wherein the bridges 104 provide readily gripable handles by people who find themselves afloat in emergency situations. It is certainly comforting and perhaps critical to survival for people who find themselves in the water after a marine mishap to have a common object to couple in proximity to one another, whether they are wearing life preservers or not. Accordingly, balls configured with handles, such as the balls of FIGS. 5–9 which are releasable from a vessel should the vessel capsize or sink provide useful emergency flotation devices. Moreover, the balls 100 may be accurately thrown to people who find themselves in an emergency situation when afloat.

The ball 100 is preferably equipped to be highly visible by being in phosphorescent colors. Moreover, the ball 100 may include a light source or may be illuminated by phosphorescence or fluorescence by using materials such as those used in a light stick.

In addition, the balls are inflatable, a tubular mouth piece may be provided or the balls may be inflated by a gas cartridge such as a $CO_2$ cartridge.

The aforementioned configurations provide balls with surfaces having indentations so that the balls may be readily gripped with surfaces of the indentations and outer surfaces of the balls cooperating to provide handles allowing a person to positively hold a ball with one hand. The balls according to the present invention may be of any size, shape or color and the material or the balls may be rubber, plastic, fabric leather or any other suitable material. The number of handles can be one or two or more and the ball can be used for any game for adults or children. The handles enable ease of handling so that a handicapped person or young child may readily use the ball with one hand. In other words, the handles in the ball allow easier use of the ball for those with less ability to hold a round object, especially with one hand (disabled individual, young children just learning to grasp, etc.) Moreover, with handles imbedded in a ball it can be held by any of the handles or grasped on the exterior like other ball. The ball with handles is an improvement on balls without handles. The balls previously described are used in the same way as current balls, only the added feature of handles makes the balls of the present invention easier to grasp and more accessible to use, as well as more versatile to throw.

From the foregoing description, one skilled in the art can easily ascertain the essential characteristics of this invention, and without departing form the spirit and scope thereof, can make various changes and modifications of the invention to adapt it to various usages and conditions.

I claim:

1. A floating ball of a size and configuration sufficient to provide a floating water safety device comprising:

A body having an outer surface of a sufficient extent to define a volume sufficient to accommodate at least a portion of each of the four fingers of a person's hand;

The body displacing a mass of water equal to the mass of the body wherein the body floats on water;

At least two indentations in the outer surface of the body, the indentations having a depth sufficient to receive at least a portion of each of the four fingers of the person's hand;

A gripping surface within the indentations against which at least tip portions of the four fingers of one press wherein at least two people adrift in deep water can grip the floating ball and remain together or where the floating ball can be thrown to a person immersed in water, and There are four indentations and associated gripping surfaces allowing several people to link up to a single safety floatation device.

2. The ball of claim 1 wherein the outside surface of the body defines portions of a sphere.

3. The ball of claim 1 wherein the body is made of foam.

4. The ball of claim 1 wherein the body has an inner wall surface defining a space which receives a gas or air to inflate the ball.

5. The ball of claim 4 wherein the body contains a bladder for retaining the air.

6. The ball of claim 3 wherein the indentations are spanned by bridges having the gripping surfaces thereon, the bridges dividing the indentations into two sections, on of which receives the fingers and the other of which receives the thumb of the hand.

7. The ball of claim 1 wherein the body has an inner wall surface defining a space which receives a gas or air to inflate the ball.

8. The ball of claim 1 wherein the ball is inflatable has a mouthpiece in the form of a tube for inflation.

9. The ball of claim 1 wherein the ball is inflatable and is in combination with a gas cartridge for inflating the ball.

10. The ball of claim 1 wherein the ball has a source of illumination.

11. The ball of claim 10 wherein the source of illumination is fluorescence or phosphorescence.

12. The ball of claim 10 wherein a separate light source is the source of illumination.

* * * * *